166-273 SR
2/18/86 OR 4,570,712

United States Patent [19]
Kokolis

[11] Patent Number: 4,570,712
[45] Date of Patent: Feb. 18, 1986

[54] CARBON DIOXIDE AND HYDROCARBON SOLVENT FLOODING IN A STEEPLY DIPPING RESERVOIR

[75] Inventor: George P. Kokolis, Houston, Tex.

[73] Assignee: Texaco Inc., White Plains, N.Y.

[21] Appl. No.: 558,146

[22] Filed: Dec. 5, 1983

[51] Int. Cl.[4] ..... E21B 43/16
[52] U.S. Cl. ..... 166/273; 166/268
[58] Field of Search ..... 166/266, 267, 268, 273, 166/274

[56] References Cited

U.S. PATENT DOCUMENTS 3,075,918 1/1963 Holm ..... 166/268 X
3,811,503 5/1974 Burnett et al. ..... 166/273 X
3,854,532 12/1974 Braden, Jr. ..... 166/274
3,856,086 12/1974 Braden, Jr. ..... 166/273 X
4,136,738 1/1979 Haynes, Jr. et al. ..... 166/273
4,299,286 11/1981 Alston ..... 166/268 X
4,434,852 3/1984 Morel et al. ..... 166/268 X
4,467,868 8/1984 Adamache ..... 166/273 X

*Primary Examiner*—George A. Suchfield
*Attorney, Agent, or Firm*—Jack H. Park; Kenneth R. Priem; Harold J. Delhommer

[57] ABSTRACT

The disclosed invention is a method of conducting a miscible carbon dioxide and hydrocarbon solvent flood in a steeply dipping reservoir. A mixture of carbon dioxide and light hydrocarbon solvent is injected in the updip end of the reservoir in such a ratio as to achieve at least multiple contact miscibility between the mixture and the formation hydrocarbons. As the flood front moves downdip with increasing formation pressure, the amount of injected enriching hydrocarbon solvent is decreased while multiple contact miscibility is maintained in the flood front. Hydrocarbons and carbon dioxide are recovered from at least one production well downdip of the injection well.

9 Claims, No Drawings

CARBON DIOXIDE AND HYDROCARBON SOLVENT FLOODING IN A STEEPLY DIPPING RESERVOIR

BACKGROUND OF THE INVENTION

This invention relates to a method for conducting a miscible carbon dioxide and hydrocarbon solvent flood in a steeply dipping reservoir wherein the concentration of hydrocarbon solvent in the carbon dioxide and solvent mixture is decreased as the flood front moves downdip into reservoir areas of higher formation pressure and temperature.

One popular method for enhanced oil recovery is that of miscible flooding wherein a solvent such as carbon dioxide is injected into the reservoir to increase recovery. For any substantial recovery to occur, the carbon dioxide must be at least partially miscible with the reservoir hydrocarbons. Generally, the greater the miscibility of the carbon dioxide, the greater the hydrocarbon recovery. In terms of cost and availability, carbon dioxide is one of the most promising solvents for miscible flooding. Unfortunately, carbon dioxide is frequently not miscible with hydrocarbons in many reservoirs. Thus, methods of mixing other solvents with the carbon dioxide have been developed. The most popular additives to carbon dioxide for creating a miscible flooding system have been various light hydrocarbon solvents, particularly paraffins in the $C_2$ to $C_6$ range. Non-hydrocarbons such as hydrogen sulfide may also be added to aid miscibility.

U.S. Pat. No. 2,875,830 discloses an enhanced oil recovery method if injecting a mixture of carbon dioxide and light hydrocarbons to increase recovery. The patent discloses the use of light hydrocarbons in the range of ethane to decane. A second reference, U.S. Pat. No. 3,811,503 emphasizes the use of light hydrocarbons such as $C_1$ through $C_4$ for mixing with $CO_2$ to create a conditional miscible transition zone which is injected ahead of a carbon dioxide flood.

SUMMARY OF THE INVENTION

The present invention is a method of conducting a miscible carbon dioxide and hydrocarbon solvent flood in a steeply dipping reservoir, wherein the concentration of hydrocarbon solvent in the carbon dioxide-solvent mixture is decreased over time as the carbon dioxide and solvent flood front moves downdip to reservoir areas of higher formation pressure and temperature. The method involves injecting a mixture of carbon dioxide and light hydrocarbon solvent into the reservoir in a ratio needed to achieve at least multiple contact miscibility between the mixture and the underground hydrocarbons at the point of injection, decreasing the injected ratio of hydrocarbon solvent to carbon dioxide as the carbon dioxide and solvent flood front moves downdip to areas of increasing formation pressure and temperature, and recovering the hydrocarbons and carbon dioxide from at least one production well which is located downdip of the injection well.

DETAILED DESCRIPTION

In its broadest aspect, the invention comprises the injection of a mixture of carbon dioxide and enriching hydrocarbon solvent in a steeply dipping reservoir in such a ratio that the flooding mixture achieves at least multiple contact miscibility with the underground hydrocarbons, and then reducing the amount of hydrocarbon solvent added to the injected carbon dioxide mixture over time as flooding continues and less enriching solvent is needed at the flood front. The invention resides in the fact that in a steeply dipping reservoir (having a dip angle of greater than about twenty degrees) the reservoir conditions of pressure and temperature and concentration of lighter reservoir hydrocarbons can change dramatically over the length of the dipping reservoir. As the vertical depth of a dipping reservoir increases, generally formation pressure and relative concentrations of light formation hydrocarbons increases. The miscibility of carbon dioxide increases under these conditions and consequently, less hydrocarbon solvent additive is required in the flood front to achieve miscibility as the flood front moves towards deeper portions of the dipping reservoir.

Decreasing the amount of added hydrocarbon solvent to the flood front while achieving miscibility with the formation hydrocarbons yields substantial cost savings over the prior art methods of conducting a miscible carbon dioxide-hydrocarbon solvent flood. This method is only applicable to updip injection in a steeply dipping reservoir having a dip angle of greater than about twenty degrees.

The first step of the method involves determining the critical ratio of light hydrocarbon solvent to carbon dioxide which is needed to attain multiple contact miscibility or first contact miscibility, if that is the objective, with the formation hydrocarbons. At this ratio the mixture contains the minimum concentration of light hydrocarbon to carbon dioxide that is required to have miscibility exist with the underground hydrocarbons. It is generally desired to have a slight safety factor, whereby the concentration of added hydrocarbon solvent to carbon dioxide is slightly increased over the minimum required concentration to handle any slight variations in formation conditions and still achieve miscibility. A suggested safety factor is about an additional 0.5% in $CO_2$ pseudo mole percent (see Example 1).

The critical ratios for miscibility can be determined by several means. One method of determining the critical ratio for miscibility is the use of slim tube miscible displacement tests which are commonly used to establish conditions simulating a hydrocarbon enriched carbon dioxide drive in hydrocarbon reservoirs.

One manner of conducting slim tube tests is to fill a 40 foot long tube with sand and then saturate the sand with the oil of interest. The displacing fluids having variable compositions of carbon dioxide and light hydrocarbon additives are injected at given rates and displacement of the oil in the slim tube is monitored by means of observing the effluent from the tube. Observation of the first appearance of the gas phase can be noted and recovery determined at the point in time of the appearance of two phases.

In one series of tests using a given reservoir oil, displacement studies were conducted at a pressure of 1,250 psi and a temperature of 54° C. Under these conditions, and for this particular oil, a flood using 100% carbon dioxide resulted in oil recovery of approximately 80% indicating that the oil and carbon dioxide were not miscible. In a second series of tests in which the displacing slug contained 10% of $C_2$–$C_4$ and 90% carbon dioxide, recovery was 96%, indicating much more than adequate miscibility with hydrocarbons in the slim tube.

Based on slim tube displacement studies and other tests known to those skilled in the art, mathematical correlations can be developed which will predict the compositions of injected mixtures needed to obtain miscibility under given reservoir conditons.

Because of practical limitations, such as the ability of mathematical correlations to accurately model a reservoir and small variations in reservoir conditions, it is thought necessary to have at least a 100 psig pressure differential between the injection and production wells. Without this minimum pressure differential, it is not practical at present to practice the invention by altering the ratio of light hydrocarbon solvent to carbon dioxide with any degree of accuracy. Thus, depending on the formation, the 100 psig difference translates into a minimum of about 250 vertical feet between the injection and production wells and preferably 500 feet or more. The amount of carbon dioxide and other additives in a flood can be varied in the field to within one-tenth of a mole percent to achieve savings over the above minimum distances.

The enriching hydrocarbon solvents may be alkanes ranging from 1 to 15 carbon atoms. The preferred enriching hydrocarbon solvents are the lighter molecular weight alkanes, preferably ethane, propane and butane. In addition, various mixtures of the different alkanes or hydrogen sulfide may be employed as the enriching hydrocarbon solvent.

The following examples further illustrate the novel method of conducting a miscible carbon dioxide and solvent flood in a steeply dipping reservoir. These examples are given by way of illustration and not as limitations on the scope of the invention. Thus, it should be understood that the steps and materials employed in the instant method may be varied to achieve similar results within the scope of the invention.

EXAMPLE 1

One mathematical correlation which has been developed by Texaco Inc., to estimate minimum miscibility pressure is:

$$P_{min}=62995.0(T)^{1.0561}\times(C_1+N_2)^{0.1419}\times(API)^{-0.8092}\times(CO_2)^{-1.2452}\times(C_2-C_4)^{-1.1302}$$

where:

$P_{min}$=minimum miscibility pressure (psia),

T=temperature (°F.), $C_1+N$=mole percentage of methane and nitrogen in the reservoir oil, API=gravity of stock tank oil (°API), $C_2$-$C_4$=mole percentage of $C_2$ through $C_4$ in the reservoir oil and $CO_2$=pseudo mole percent $CO_2$ in $CO_2$ and solvent mixture.

This value is a pseudo percentage because it represents a function of the $CO_2$/solvent weight average critical temperatures—not the actual mole percentage of $CO_2$ in the $CO_2$/solvent mix. Thus, this value can exceed 100%.

A 100% pseudo mole percent carbon dioxide means that pure 100% carbon dioxide will achieve multi-contact miscibility with the underground hydrocarbons at the assumed conditions. A carbon dioxide pseudo mole percent greater than 100% means that it will be necessary to add enriching hydrocarbon solvent.

The above mathematical correlation was employed to calculate the pseudo percentage carbon dioxide reqired at different depths for a segment of a steeply dipping reservoir in Southeastern Louisiana. The particular reservoir has a dip angle of about thirty-six degrees and 36° API gravity oil. Table I resulted from applying the mathematical correlation to the reservoir conditions.

A related mathematical correlation was employed to calculate the amount of butane additive needed with carbon dioxide to achieve the miscible flood conditions represented by the pseudo mole percent carbon dioxide figures of Table I. The correlation which is valid between about 1000–4000 psig and about 100°–200° F. is pseudo $CO_2\%=100+3.69(C_4$ mole %).

TABLE I

| depth (ft) | T (°F.) | P (psia) | $C_1+N_2$ (%) | $C_2$-$C_4$ (%) | pseudo $CO_2$ % | $CO_2$ mole % | $C_4$ mole % |
|---|---|---|---|---|---|---|---|
| 7600 | 169 | 3359 | 48.5 | 5.99 | 103.03 | 99.18 | 0.82 |
| 7700 | 170 | 3403 | 48.78 | 6.00 | 102.52 | 99.32 | 0.68 |
| 7800 | 171 | 3447 | 49.06 | 6.01 | 102.02 | 99.45 | 0.55 |
| 7900 | 172 | 3491 | 49.37 | 6.03 | 101.53 | 99.59 | 0.41 |
| 8000 | 174 | 3535 | 49.56 | 6.04 | 101.53 | 99.59 | 0.41 |
| 8100 | 175 | 3579 | 49.83 | 6.05 | 101.06 | 99.71 | 0.29 |
| 8200 | 176 | 3623 | 50.13 | 6.06 | 100.61 | 99.83 | 0.17 |
| 8300 | 177 | 3667 | 50.38 | 6.07 | 100.16 | 99.96 | 0.04 |
| 8400 | 179 | 3711 | 50.57 | 6.08 | 100.18 | 99.95 | 0.05 |
| 8500 | 180 | 3755 | 50.85 | 6.09 | 99.75 | 100.00 | 0 |

An examination of the column of pseudo percentage carbon dioxide reveals a substantial difference between the pseudo carbon dioxide percentage needed for miscibility at 7,600 feet and that needed at 8,500 feet in the steeply dipping reservoir. At 7,600 feet, light hydrocarbon solvent in a concentration of greater than 3 pseudo mole percent carbon dioxide must be added to the carbon dioxide. But once the advancing flood front reaches the 8,500 foot depth in the dipping reservoir, the percentage of added hydrocarbon solvent in the advancing flood front can be reduced to 0, after including a safety factor, yielding a substantial cost savings over presently accepted methods of conducting mixed carbon dioxide and light hydrocarbon solvent miscible floods.

The last 2 columns in Table I illustrate the reductions in enriching butane that can be achieved in a dipping reservoir while still maintaining miscibility. By decreasing butane addition to the injected carbon dioxide from 0.82 mole % to 0 mole % over a vertical distance of about 900 feet in the dipping reservoir, substantial cost savings can be achieved.

A quick calculation illustrates the cost savings of the invention wherein the amount of light hydrocarbon solvent injected is decreased over the life of the flood. Assuming a constant injection rate and the injection of the same volume of gas over each 100 vertical foot interval, the method of the invention requires only 58% of the butane required by the prior art method of injecting 99.18 mole % $CO_2$ and 0.82 mole % butane over the lift of the Table I flood. These savings can reach several million dollars for field floods.

Many other variations and modifications may be made in the concepts described above by those skilled in the art without departing from the concepts of the present invention. Accordingly, it should be clearly understood that the concepts disclosed in the description are illustrative only and are not intended as limitations on the scope of the invention.

What is claimed is:

1. A method of conducting a miscible carbon dioxide and solvent flood in a steeply dipping reservoir, consisting essentially of:

(a) injecting through at least one injection well a mixture of carbon dioxide and enriching hydrocarbon solvent at the updip end of a dipping hydrocarbon reservoir for forming a carbon dioxide and solvent front advancing to the downdip end of the reservoir, said enriching solvent mixed with the carbon dioxide in a concentration sufficient to achieve at least multiple contact miscibility between said mixture and the underground hydrocarbons at a point of injection into the reservoir;

(b) decreasing the concentration of hydrocarbon solvent in carbon dioxide while maintaining at least multiple contact miscibility between the injected mixture of carbon dioxide and decreased concentration solvent and the underground hydrocarbons as the carbon dioxide and solvent front moves downdip, said concentration of solvent decreased as the concentration of solvent needed to maintain at least multiple contact miscibility decreases with increasing vertical depth in the formation; and (c) recovering hydrocarbons and carbon dioxide from at least one production well located downdip of the injection well.

2. The method of claim 1, wherein the dipping reservoir has a dip angle of greater than about twenty degrees.

3. The method of claim 1, wherein the production well produces from an area at least 250 vertical feet below the injection well.

4. The method of claim 1, wherein the formation pressure differential between the injection well and the production well is at least 100 psig.

5. The method of claim 1, wherein the enriching hydrocarbon solvent is an alkane having from one to fifteen carbon atoms.

6. The method of claim 5, wherein the enriching hydrocarbon solvent is a mixture of different alkanes.

7. The method of claim 5, wherein the enriching hydrocarbon solvent is butane.

8. The method of claim 1, wherein hydrogen sulfide is added to the injected carbon dioxide.

9. A method of conducting a miscible carbon dioxide and solvent flood in a reservoir with a dip angle of greater than twenty degrees, consisting essentially of:

(a) injecting through at least one injection well a mixture of carbon dioxide and an enriching alkane solvent having from one to fifteen carbon atoms at the updip end of a dipping hydrocarbon reservoir for forming a carbon dioxide and solvent front advancing to the downdip end of the reservoir, said enriching alkane mixed with the carbon dioxide in a concentration sufficient to achieve at least multiple contact miscibility between said mixture and the underground hydrocarbons at a point of injection into the reservoir;

(b) decreasing the concentration of hydrocarbon solvent in carbon dioxide while maintaining at least multiple contact miscibility between the injected mixture of carbon dioxide and decreased concentration solvent and the underground hydrocarbons as the carbon dioxide and alkane front moves downdip, said concentration of solvent decreased as the concentration of solvent needed to maintain at least multiple contact miscibility decreases with increasing vertical depth in the formation; and (c) recovering hydrocarbons and carbon dioxide from at least one production well located downdip of the injection well and having a formation pressure at least 100 psig higher than the point of injection of the carbon dioxide.

* * * * *